US009656107B2

(12) United States Patent
Zlatintsis

(10) Patent No.: US 9,656,107 B2
(45) Date of Patent: May 23, 2017

(54) TRIGGER UNIT FOR EXTINGUISHING DEVICES

(71) Applicant: Minimax GmbH & Co. KG, Bad Oldesloe (DE)

(72) Inventor: Chrysafis Zlatintsis, Luebeck (DE)

(73) Assignee: Minimax GmbH & Co. KG, Bad Oldesloe (DE)

( * ) Notice: Subject to any disclaimer, the term of this patent is extended or adjusted under 35 U.S.C. 154(b) by 63 days.

(21) Appl. No.: 14/614,997

(22) Filed: Feb. 5, 2015

(65) Prior Publication Data

US 2015/0231432 A1 Aug. 20, 2015

(30) Foreign Application Priority Data

Feb. 17, 2014 (EP) ..... 14155367

(51) Int. Cl.
*A62C 37/46* (2006.01)
*A62C 3/00* (2006.01)

(52) U.S. Cl.
CPC ..... *A62C 37/46* (2013.01); *A62C 3/006* (2013.01)

(58) Field of Classification Search
CPC ..... A62C 3/006; A62C 37/04; A62C 37/08; A62C 37/10; A62C 37/11; A62C 37/36; A62C 37/38; A62C 37/42; A62C 37/46
USPC ..... 169/56, 60, 61, 65; 239/574
See application file for complete search history.

(56) References Cited

U.S. PATENT DOCUMENTS 4,979,572 A 12/1990 Mikulec
6,286,604 B1 9/2001 Ou
7,303,024 B2 * 12/2007 Mikulec ..... A62C 3/006 169/59
2005/0126797 A1 6/2005 Mikulec

FOREIGN PATENT DOCUMENTS

DE 20209353 U1 11/2002
EP 2711053 A1 3/2014

* cited by examiner

*Primary Examiner* — Christopher Kim
(74) *Attorney, Agent, or Firm* — Harness, Dickey & Pierce, P.L.C.

(57) ABSTRACT

A trigger unit (1) for triggering an extinguishing-agent flow in the direction of a fire zone, connected to an energy supply, having a first actuating device (3) that can be switched between a release position in which the energy supply is released, and an interruption position in which the energy supply is interrupted, a second actuating device (5) that can be switched between a release position in which the extinguishing-agent flow is released, and a rest position, a coupling unit (7) that can be moved between an operating position and an extinguishing position and permanently couples together the switching of the first actuating device (3) and the second actuating device (5). A tensioning element is connected in a force-transmitting manner to the coupling unit (7) in such a manner that a change in the tensioning state of the tensioning element always results in a movement of the coupling unit (7).

15 Claims, 4 Drawing Sheets

TRIGGER UNIT FOR EXTINGUISHING DEVICES

CROSS-REFERENCE TO RELATED APPLICATIONS

This application claims the benefit and priority of European Application No. 14155367.7, filed Feb. 17, 2014. The entire disclosures of the above application is incorporated herein by reference.

FIELD

The disclosure relates to a trigger unit for extinguishing devices for triggering an extinguishing-agent flow in the direction of a fire zone, said zone being connected to an energy supply, having a first actuating device that can be switched between a release position in which the energy supply is released, and an interruption position in which the energy supply is interrupted, and a second actuating device that can be switched between a release position in which the extinguishing-agent flow is released, and a rest position, and a coupling unit that can be moved between an operating position and an extinguishing position and permanently couples together the switching of the first actuating device and of the second actuating device.

BACKGROUND

The disclosure further relates to an extinguishing device for extinguishing fires having a trigger unit for triggering an extinguishing-agent flow, a propellant cartridge for providing a propellant, and an extinguishing-agent reservoir.

Such trigger units and extinguishing devices are usually utilized in canteen kitchens. Legal requirements and regulations and the constantly increasing demands of the operators of industrial canteen kitchens on the extinguishing systems require constant further development of the system components so that the required standards can be complied with.

Fires can often be fought effectively only if in addition to an extinguishing agent being applied also the energy supply to the appliances used is interrupted, for example the gas supply to a gas-operated stove. In known extinguishing systems, it is for example water, chemical extinguishing agents, foaming extinguishing agents and extinguishing gases such as nitrogen, argon, $CO_2$, extinguishing-gas mixtures and other extinguishing agents, such as powdered extinguishing agents and aerosol extinguishing agents that are used as the extinguishing agent.

Known stationary extinguishing systems that exhibit mechanical trigger units usually exhibit a tensioning device for pretensioning a movable element. In the case of a fire, a trigger mechanism effects that the pretensioned element moves on account of the restoring force that acts, and thus actuates a release device such that an extinguishing operation is initiated. Such a trigger unit is for example disclosed from DE 20 2011 104 314 U1.

Other extinguishing systems exhibit a plurality of tensioning devices that have to be tensioned using a high degree of force when the extinguishing system is commissioned, so that in the case of a fire the interruption of the energy supply and initiating the extinguishing-agent flow in the direction of the fire zone can be guaranteed.

This means that a plurality of tensioning operations have to be carried out when commissioning such extinguishing systems, before the extinguishing system is ready to operate.

Correct execution of the individual tensioning operations is essential for the function of the extinguishing systems and represents a potential source for faults.

Because of the necessity for a plurality of tensioning mechanisms, known extinguishing systems further exhibit a complex mechanical construction. In conjunction with a high part count, this complex mechanical construction leads to high production costs, in particular to high costs in the final assembly. The separate tensioning mechanisms further lead to an increased risk of component failure so that the operational reliability of the extinguishing systems is likewise impaired by the separate tensioning mechanisms.

A further disadvantage of known extinguishing systems or trigger units is the requirement for a high degree of force for carrying out the tensioning operations for commissioning the systems. This is the case in particular if manufacturers use pretensioning springs having a high spring stiffness in the pretensioning mechanisms. Known solutions lack suitable force-stroke conversions for reducing the required force when commissioning the systems.

The object on which the disclosure is based is therefore to be seen in providing a trigger unit and an extinguishing device that overcome at least partly the disadvantages described above. The disclosure was in particular based on the object of reducing the required steps for commissioning an extinguishing device so that the error potential is minimized when commissioning an extinguishing system, and in providing a trigger unit and an extinguishing device that can be commissioned with reduced force.

In a first aspect, the object on which the disclosure is based is achieved by means of a trigger unit of the type mentioned at the beginning, the trigger unit exhibiting a tensioning element that is connected in a force-transmitting manner to the coupling unit in such a manner that a change in the tensioning state of the tensioning element always results in a movement of the coupling unit.

The disclosure uses the finding that the dependence of individual actuating devices on in each case separate tensioning mechanisms can be broken by means of a coupling unit and suitable cooperation of coupling unit and tensioning element.

The tensioning element is designed to store energy, preferably potential energy. A change in the tensioning state of the tensioning element leads to a change in the energy stored in the tensioning element. At least parts of the tensioning element are preferably designed such that they can be deformed elastically, so that a change in the tensioning state is linked to a change of the shape of these parts.

The energy supply linked to the fire zone, which supply can be released and interrupted using the first actuating device, for example comprises the supply of a flammable fluid and/or the supply of electric power. A multiplicity of different stove systems like electric stoves, gas stoves and electric/gas combination systems can be operated by means of supplying the types of energy named above. A fire zone can, for example, be understood to be an area of a canteen kitchen in which the stovetop/stove flame is arranged and where therefore an extinguishing device having an inventive trigger unit should be operated.

After commissioning the inventive trigger unit, the extinguishing-agent flow is interrupted in the rest position of the second actuating device prior to the first triggering operation. The extinguishing-agent flow is released by switching the second actuating device from the rest position into the release position. When the second actuating device is then switched from the release position into the rest position, the extinguishing-agent flow is not necessarily interrupted again.

In a first preferred embodiment of the inventive trigger unit, coupling the first actuating device to the second actuating device takes place in such a manner that in the operating position of the coupling unit the first actuating device is in the release position and the second actuating device is in the rest position. In contrast, in the extinguishing position of the coupling unit the first actuating device is in the interruption position and the second actuating device in the release position.

The mobility of the coupling unit is preferably achieved by designing the coupling unit as a cylindrical piston or bolt that is guided so as to be moveable, in particular linearly displaceable, on the support structure of the trigger unit. By means of a linear movement inside a guide on the support structure, the coupling unit can thus be moved between the operating position and the extinguishing position.

As an alternative, the coupling unit is mounted pivotably on the support structure of the trigger unit in a further preferred embodiment. In the case of such a design, the movement between the operating position and the extinguishing position might be carried out by rotating the coupling unit.

It is to be understood that the extinguishing-agent flow can both be initiated and also maintained in the release position of the second actuating device.

The first actuating device preferably cooperates with a valve or a switch or exhibits a valve or a switch as actuating element for releasing the gas supply for a gas stove in the release position and to interrupt this gas flow in the interruption position by means of a suitable valve or switch position. As an alternative, the first actuating device can cooperate with a switch or exhibit a switch as actuating element that is designed to release or to interrupt an electrically conducting connection. Such an actuating device would, for example, be utilized when using the inventive trigger unit in connection with an electric-stove system.

In a preferred embodiment of the inventive trigger unit, the tensioning element applies a restoring force on the coupling unit in the direction of the extinguishing position in the operating position of the coupling unit. The tensioning element preferably exhibits a spring, in particular a compression spring. In particular helical springs having a cylindrical construction that are arranged such that they align with the coupling unit on the support structure of the trigger unit, are preferred. In the sense of the meaning of the disclosure, the spring can, as an alternative, also be designed as a helical tension spring, as a torsion spring, as a flexible spring, an air spring, a gas-pressure spring or an elastomeric spring. All these spring types share the attribute that they can be used as a storage means for potential energy. When the trigger unit is triggered, the stored potential energy is converted into kinetic energy that is transferred to the coupling unit and thus leads to a movement of the coupling unit.

The inventive trigger unit preferably exhibits a holding and tensioning mechanism that is designed to accommodate the restoring force of the tensioning element in the operating position of the coupling unit. By means of the holding and tensioning mechanism and of the tensioning element, the coupling unit can thus be pretensioned. The holding and tensioning mechanism holds the coupling unit in the operating position, while the tensioning element exerts a restoring force on the coupling unit in the direction of the extinguishing position. By pretensioning the coupling unit, only suitable initiation is required, i.e. a discontinuation of the abutment force for pretensioning, for example a loss of pulling force in the holding and tensioning mechanism, to release a movement and thus to realize a movement of the coupling unit from the operating position into the extinguishing position. In the extinguishing position of the coupling unit, the tensioning element exhibits less potential energy than in the operating position of the coupling unit, so that even in the extinguishing position the tensioning element can still be in a tensioned state. In the extinguishing position, the tensioning element can further also be in an untensioned state.

Particularly preferable is a trigger unit whose holding and tensioning mechanism comprises a first cable, the first cable being connected to the coupling unit via a deflection element. As a result of the deflection of the first cable, a first side of the first cable and a second side of the first cable are created. The deflection elements can, for example, be designed as a pulley that is mounted rotatably to the coupling unit. The axle, on which the deflection element can rotate, is preferably designed as a pin that is connected to the coupling unit. As a consequence, when the coupling unit is moved between the operating position and the extinguishing position, the deflection element likewise experiences a change in position that corresponds to that of the coupling unit. The deflection element exhibits in particular lateral flanks so that reliable guidance of the first cable is ensured.

In a further preferred embodiment of the inventive trigger unit, the holding and tensioning mechanism exhibits a holding member that is fastened to a first end of the first cable. The holding member is adapted to release the first cable when a limit value representing fire characteristics is reached or exceeded or when an electrical deactivating signal is present, caused by a fire-alarm signal. A fire-alarm signal is detected and/or triggered by a fire detector and/or a fire detection panel and/or extinguishing control panel if one or more limit values representing fire characteristics are exceeded or changes of one or more fire characteristics that characterize a fire or a fire that is starting are detected by corresponding evaluation algorithms. The fire detector or the fire detection panel and/or extinguishing control panel or a control unit then generate an electrical deactivation signal that is transmitted to the holding member via a signal-conducting connection.

As a fire characteristic in the meaning of the disclosure, for example temperature values can be understood. Furthermore, an aerosol concentration can be regarded as a fire characteristic so that the first cable can be released also as a function of smoke development. Further characteristics can be radiation values, in particular infrared radiation values or ultraviolet radiation values, or gas concentrations. Releasing the first cable as a function of the limit value of a gas concentration being exceeded, also permits the first cable to be released as a function of chemical decomposition products. As long as one or more limit values representing fire characteristics are not exceeded or no deactivation signal is present, a tensile force acting on the holding and tensioning mechanism can be maintained. If in the case of a fire one or more limit values representing fire characteristics are exceeded or if a fire-alarm signal was triggered, the first cable is released. The holding member is preferably designed as a thermal separation member that can be destroyed under the effect of a temperature increase in the case of a fire. If the holding member is designed as a thermal separation member, the first cable is released by destroying the thermal separation member. The destruction of the thermal separation member is caused by a temperature limit value being exceeded. The tensile force applied on the holding and tensioning mechanism can thus no longer be transmitted via the first cable. As a result, the holding and tensioning mechanism can no longer absorb the restoring force applied on the coupling unit by the tensioning element. On the one hand, this leads to the coupling unit being moved from the operating position into the extinguishing position. Actuation of the first actuating device and of the second actuating device resulting therefrom leads to the energy supply, for example the gas supply, being interrupted and an extinguishing-agent flow in the direction of the fire zone connected to the energy supply being initiated and as a result being maintained at least temporarily. As an alternative or additionally, also the first cable used can exhibit one or more thermal separation members or be partly or completely constructed from a material that is destroyed when a temperature limit value is exceeded.

In a further advantageous design of the disclosure, the holding member comprises a magnetic holding element and a deactivatable permanent magnet. The magnetic holding element adheres to the deactivatable permanent magnet. The holding element is attached to a first element of the first cable or it is part of the first cable, preferably of the first cable end. The deactivatable permanent magnet is preferably connected to a stationary part, e.g. a wall or the support structure of the trigger unit.

In the case of a fire or a fire just starting, a fire-alarm signal generates an electric deactivation signal and the permanent magnet is deactivated. Deactivation is understood to mean the cancellation of the magnetic field of the permanent magnet or its attenuation so that the holding element adhering to the permanent magnet and thus also the first cable is released. This leads to the coupling unit being moved as described when destroying a holding member designed as thermal separation member. The electrical deactivation signal is preferably designed as a voltage signal that is applied e.g. to a coil that causes the magnetic field of the electrically deactivatable permanent magnet to be demagnetized or attenuated. The coil is arranged on the permanent magnet.

It can furthermore be advantageous that the electrically deactivatable permanent magnet is connected in a signal-conducting manner to a fire detector, a sensor or a control panel. In advantageous design variants, the control panel can, for example, be a fire detection control panel, a fire detection panel and/or extinguishing control panel, an extinguishing control panel or a control room.

It is further preferred that the holding and tensioning mechanism of the trigger unit exhibits a stationary and rotatably mounted reel to which the first cable is fastened and on which it can be wound and unwound. It is in particular preferable that the reel is accessible from outside and can be operated manually. In this way, for example after triggering the trigger unit, the holding and tensioning mechanism can be tensioned anew by winding the first cable. By winding the first cable of the holding and tensioning mechanism, the coupling unit can be moved again from the extinguishing position into the operating position after the trigger unit has been triggered. As a result of the first actuating device and the second actuating device being coupled, they are also switched at the same time. Here, the first actuating device is switched from the interruption position into the release position when the first cable is wound or when the holding and tensioning mechanism is tensioned, and the second actuating device is switched from the release position into the rest position. In a simple manner, a triggered trigger unit can thus be brought again into a tensioned state.

In a further preferred embodiment of the inventive trigger unit, the first actuating device comprises a first cable that is fastened to the coupling unit. In combination with the first cable of the holding and tensioning mechanism, the deflection element and the reel, the first cable of the first actuating device forms a block and tackle. In this way, the force required for pretensioning the tensioning element can be reduced considerably. Commissioning an extinguishing device having such a trigger unit is simplified as a consequence.

The inventive trigger unit is preferably further developed in that the holding and tensioning mechanism exhibits a locking element that can be moved between a locking position and a release position. In the locking position of the locking element, the rotational movement of the reel is locked. In the release position of the locking element, the rotational movement of the reel is enabled. As a result of moving the locking element, the reel can be immobilized so that a tensile force exerted on the first cable can be transmitted. In contrast thereto, the first cable cannot transmit any tensile force if the locking element is in the release position and thus the reel is released. When the first cable of the holding and tensioning mechanism is subjected to a tensile force, there is consequently an unwinding of the first cable from the reel.

A further embodiment of the inventive trigger unit exhibits a second tensioning element that preferably exhibits a spring, in particular a torsion spring. The second tensioning element applies a restoring force on the locking element in the direction of the locking position. If, as a result, no further force acts on the locking element, the latter is held in the locking position by means of the second tensioning element, so that the reel is locked. If the second tensioning element is designed as a torsion spring, then it transmits a restoring moment to the locking element.

The holding and tensioning mechanism of the trigger unit preferably comprises one, preferably two, three or four manual release devices. By means of the manual release devices, the locking element can be moved from the locking position into the release position by manual actuation. The release device permits the trigger unit to be triggered by manual intervention. Thus an operator can trigger the trigger unit also independently of the cable release of the holding member or of the destruction of a thermal separation member. In particular in situations where a fire can no longer be prevented, but a fire effect has not yet occurred to the extent that the holding member releases the first cable, such manual release devices can also lead to an accelerated extinction of a fire. Even in the case of a possible failure of the function of the holding member or of other individual components, discharge of an extinguishing agent in the direction of a fire zone and the interruption of the energy supply can be achieved manually. As a result, fire protection safety is increased even further.

In a further embodiment of the inventive trigger unit, a cam is fastened to a section of the first cable of the holding and tensioning mechanism and coupled to the locking element in such a way that the locking element is moved from the locking position into the release position when the first end of the first cable is released. If, for example, a thermal separation element fastened to the first end of the first cable is destroyed by exceeding a temperature limit value in the case of a fire, this end is released so that the cam is moved by the pretensioned coupling unit and thus the locking element coupled to the cam is moved from the locking position into the release position and thus the reel is released.

In a particularly preferred embodiment of the inventive trigger unit, the locking element is designed as a rocker. Here, the rocker exhibits a first arm and a second arm. The first arm of the rocker can here cooperate with the cam, while the second arm of the rocker cooperates with the reel.

It is further preferred that the second actuating device comprises an actuating arm that is preferably mounted rotatably about a stationary point. When the coupling unit is moved between the operating position and the extinguishing position, this preferably results in a rotational movement of the actuating arm of the second actuating device about this stationary point.

Particularly preferably, the actuating arm is arranged on a receiving and distributing unit. The receiving and distributing unit preferably comprises an internal thread into which a propellant cartridge can be screwed and thus connected. By means of an actuating mechanism that is coupled to the actuating arm of the second actuating device, the propellant stored under pressure in the propellant cartridge can be released. The release of the propellant preferably takes place by means of the cooperation of the actuating arm with an opening means of the actuating mechanism that is designed to open the closure of the propellant cartridge. By means of the rotational movement of the actuating arm, the opening means is moved or shifted from a passive position into an actuating position such that the closure of the propellant cartridge is subjected to a compressive force in the actuating position of the opening means. When a pressure-force threshold value is exceeded, the propellant cartridge is opened and thus releases the propellant stored under pressure, preferably compressed air or pressurized $CO_2$ or $N_2$. The actuating mechanism preferably comprises a restoring spring that cooperates with the opening means and whose restoring force acts on the opening means such that the opening means is always moved in the direction of the passive position as soon as this is permitted by the position of the actuating arm. The opening means can be designed in particular as a needle. If the opening means is designed as a needle, switching the second actuating device from the release position into the rest position does not result in an interruption of the extinguishing-agent flow. However, other actuators are also further possible as opening means. The opening means can, for example, be designed as a button embodiment so that actuation generates a switching signal for opening an on/off valve. Such an design permits the interruption of the extinguishing-agent flow when switching the second actuation device from the release position into the rest position. The receiving and distributing unit preferably further exhibits one or more outlets that are coupled to the propellant cartridge such that distribution of the propellant flow to several lines can take place. If the trigger unit is used in combination with an extinguishing device, the propellant is guided through lines to one or more extinguishing-agent reservoirs so that an extinguishing-agent flow can be initiated and thus an extinguishing-agent flow can be triggered in the direction of a fire zone. The extinguishing-agent flow is initiated by a pressure rise inside the extinguishing-agent reservoir that is caused by the propellant. The propellant guided through the line(s) into the extinguishing-agent reservoir propels the extinguishing agent from the extinguishing-agent reservoir into a further line system to one or more discharge units. The discharge units exhibit one or more discharge nozzles that give off the extinguishing agent to the fire zone.

The extinguishing-agent reservoir preferably comprises a closed container and an extinguishing agent stocked therein. When the propellant is released in the release position of the second actuating device, pressure develops in the at least one container as a result of the introduced pressurized propellant and the extinguishing agent is driven from the at least one container via fluid-conducting connections in the direction of at least one discharge unit and discharged over the seat of fire.

In a further preferred embodiment of the inventive trigger unit, the actuating arm exhibits a guide that cooperates with the coupling unit such that a movement of the coupling unit results in a rotation of the actuating arm about a stationary point. The guide preferably exhibits an elongated hole in which a pin of the coupling unit can be moved.

In a second aspect the object on which the disclosure is based is achieved by an extinguishing device of the type mentioned at the start, the trigger unit being designed according to one of the previously described preferred embodiments. Regarding the advantages of such an extinguishing device, reference is made to the remarks regarding the embodiments of the inventive trigger unit.

The object on which the present disclosure is based is further achieved by a kitchen having an extinguishing device for extinguishing fires, the extinguishing device being as described above, in particular exhibiting a trigger unit according to one of the previously described preferred embodiments.

DRAWINGS

The disclosure is described below in more detail using examples and figures.

DETAILED DESCRIPTION

Figure 1:
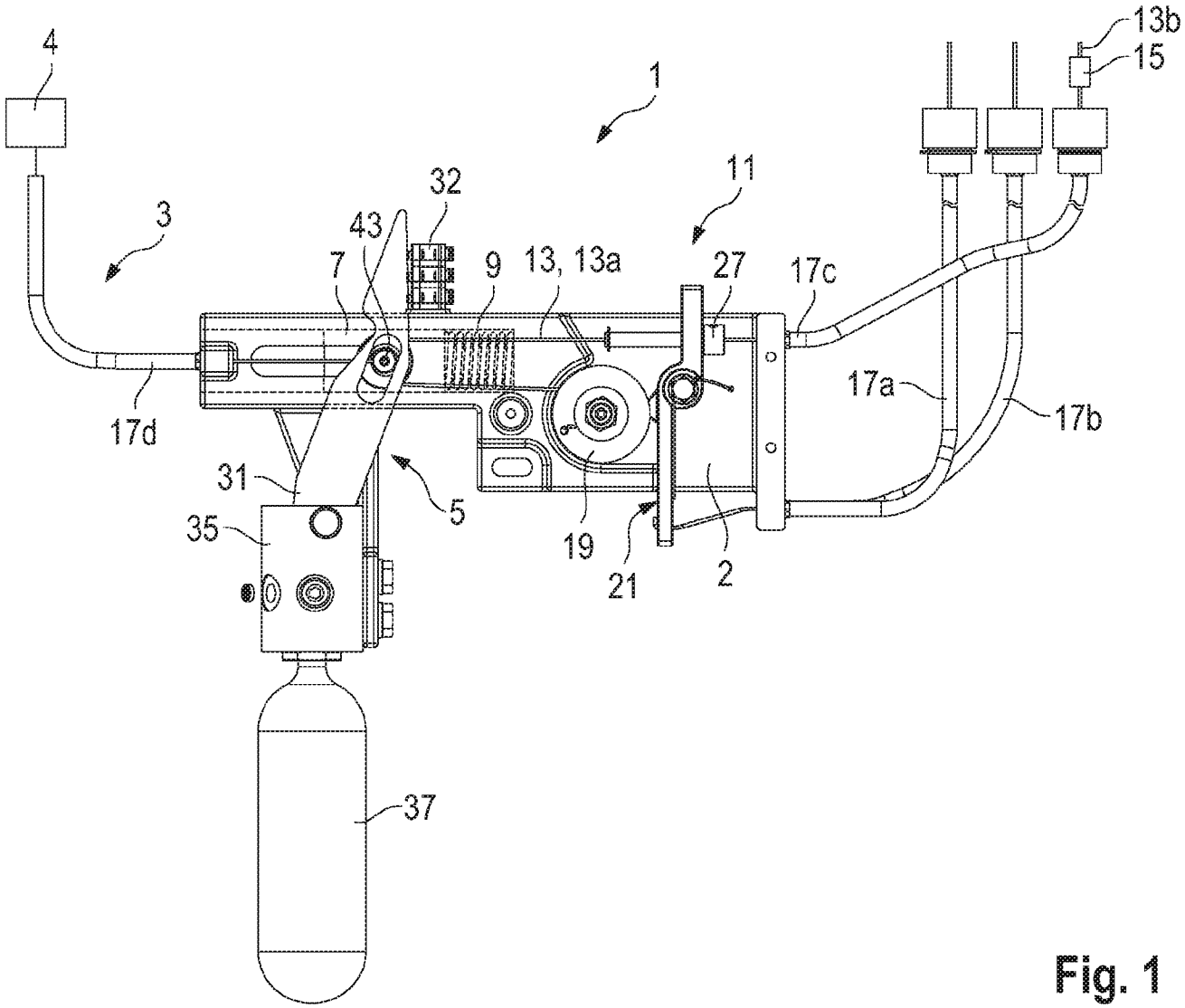
FIG. 1 shows an embodiment of an inventive trigger unit.

According to FIG. 1, the trigger unit 1 exhibits a support structure 2 on which a first actuating device 3 and a second actuating device 5 are arranged. The first actuating device 3 comprises a second cable that is connected to an actuating element 4 that is designed as a valve actuation. The valve actuation switches a gas valve connected to a gas source to supply a gas stove with gas. The first actuation device 3 is connected by a fastening element of the second cable to the coupling unit 7. The coupling unit 7 is further coupled to the actuating arm 31 of the second actuating device. The actuating arm 31 cooperates with a receiving and distributing unit 35 for releasing the propellant stored in the propellant cartridge 37 in the case of the trigger unit 1 being triggered. A pin 43 on the coupling unit 7 transmits the movement from the coupling unit 7 to the actuating arm 31 of the second actuating device 5. The trigger unit 1 further exhibits a tensioned first cable 13. A first part 13*a* of the first cable 13 is fastened at a first end to a holding member 15 designed as a thermal separating member and at a second end to a reel 19. A second part 13*b* of the first cable 13 is fastened at a first end to the holding member 15 and at a second end to a stationary device (not shown). The reel 19 is rotatably mounted, with a locking element 21 acting on the reel 19, on the support structure 2 of the trigger unit 1. In the illustrated locking position, the locking element 21 locks the reel 19 and thus prevents a rotating movement for winding or unwinding the first cable 13. The first cable 13, the reel 19, the locking element 21 and the holding member, here designed as a holding member 15, are parts of the holding and tensioning mechanism 11 that accommodates in the illustrated operating position of the coupling unit 7 the restoring force exerted by the spring 9 on the coupling unit 7 in the direction of the extinguishing position. On the first cable 13, there is further fastened a cam 27 that would rotate the locking element 21 from the illustrated locking position into a release position in the case of the destruction of the thermal separating member 15, so that on account of the restoring force exerted by the spring 9 on the coupling unit 7 an unwinding of the first cable 13 would take place if the coupling unit 7 is moved from the illustrated operating position into the extinguishing position. The cam 27 is further designed and arranged such that a small longitudinal elongation of the first cable 13, e.g. on account of temperature fluctuations, does not lead to a twisting of the locking element 21. Inadvertent triggering of the trigger unit due to temperature fluctuations is thus prevented. When the coupling unit 7 is moved in a guide of the support structure 2 from the operating position into the extinguishing position, the first actuating device 3 is further moved from a release position into an interruption position and the second actuating device 5 from a rest position into a release position. In a rest position of the second actuating device 5, the extinguishing-agent reservoir connected to the trigger unit is closed, so that extinguishing agent is prevented from leaving the extinguishing-agent reservoir. The coupling unit 7 or the actuating arm 31 is monitored by a signal transmitter 32 so that by means of suitable signal generation by the signal transmitter, further follow-up actions can be initiated automatically when the trigger unit 1 is triggered. The signal transmitter 32 can, for example, be designed to detect a contact with the actuating arm 31 and to generate a signal as a function of the contact status. Follow-up actions that can be initiated can, for example, be a signal transmission to a fire detection panel and/or extinguishing control panel, the triggering of an alarm or switching a solenoid valve, that initiates further extinguishing actions.

Figure 2:
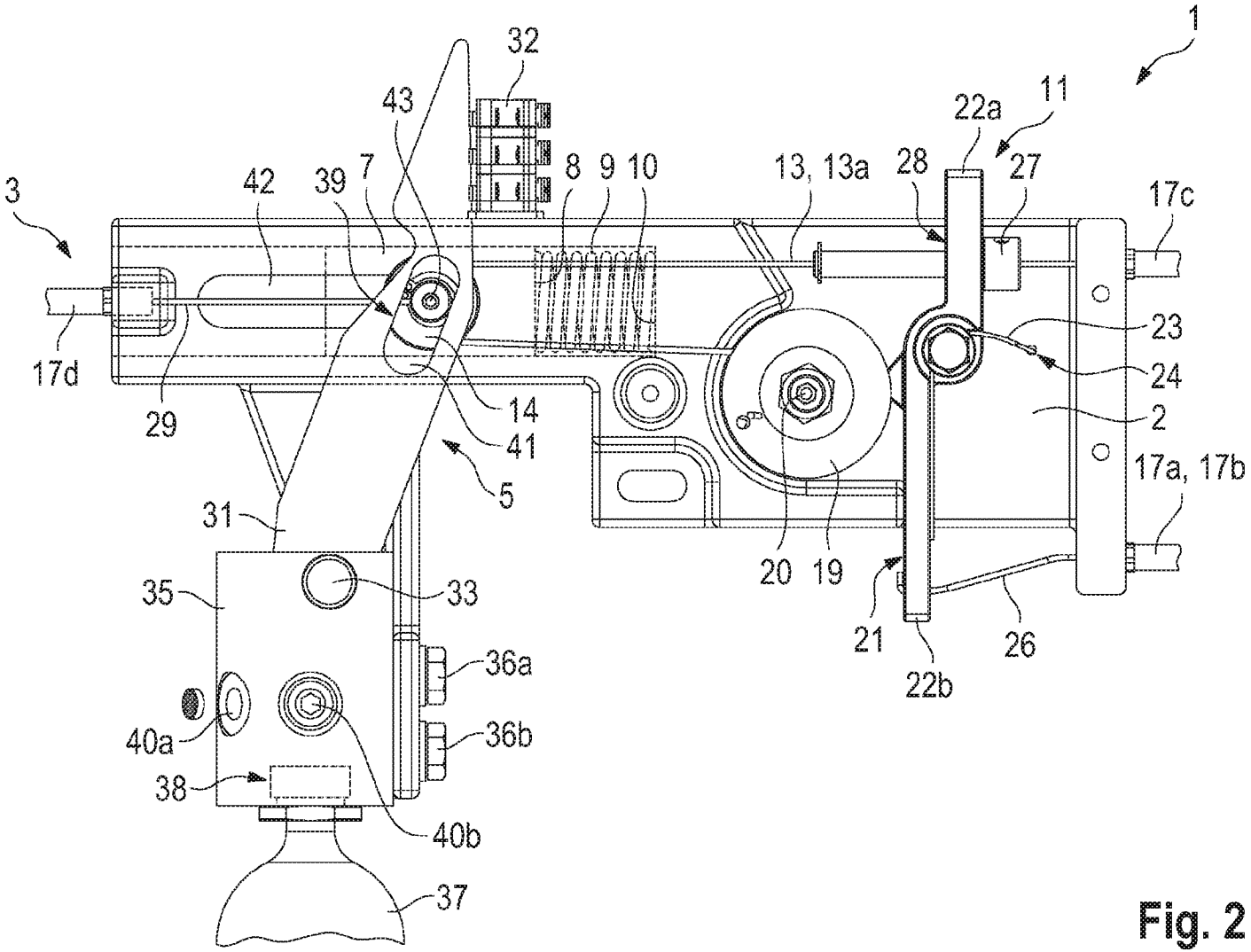
FIG. 2 shows a detailed view of the trigger unit from FIG. 1.
Figure 4:
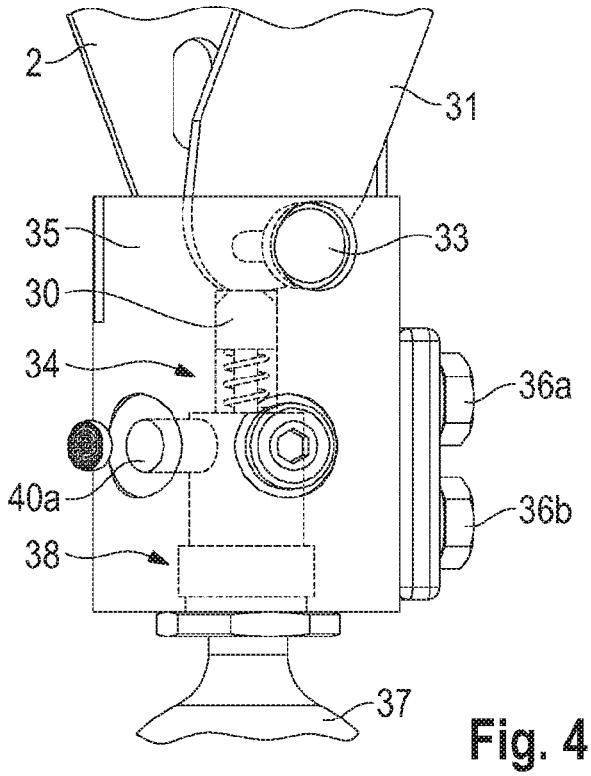
FIG. 4 shows a detailed view of the receiving and distributing unit from FIG. 1.

FIG. 2 shows a detailed view of the trigger unit 1 illustrated in FIG. 1. The coupling unit 7 and the spring 9 are arranged in the guide of the support structure 2, the spring 9 being designed as a helical spring and its first end face resting on a stop on the support structure 2 and its second end face resting on the coupling unit. The coupling unit 7 further exhibits a deflection element 14 by means of which the first part 13*a* of cable 13 can be divided into a first side and a second side. On the coupling unit 7, there is further fastened a pin 43 by means of which the second cable 29 of the first actuating device 3 is fastened to the coupling unit 7. The pin 43 projects through the elongated hole 41 of the actuating arm 31 and through the elongated hole 42 of the support structure 2 of the trigger unit 1. The actuating arm 31 is mounted on the receiving and distributing unit 35 so as to be pivotable or rotatable about the stationary point 33. By means of fittings 36*a*, 36*b*, the receiving and distributing unit 35 is bolted to a stationary arm on the support structure 2. The receiving and distributing unit 35 exhibits an internal thread 38 for receiving a propellant cartridge 37. Inside the receiving and distributing unit 35, there is further arranged an actuating mechanism that can release the propellant from the propellant cartridge 37 by a pivoting movement of the actuating arm 31. The actuating mechanism exhibits an opening means for opening the closure of the propellant cartridge 37. A restoring spring acts on the opening means and applies a restoring force on the opening means. The opening means can be designed as a needle 34, as shown in FIG. 4. The released propellant is distributed via the ports 40*a*, 40*b* to lines that guide the propellant to an extinguishing-agent reservoir. The propellant subsequently initiates an extinguishing-agent flow. The illustration in FIG. 2 further shows that the second side of the first cable 13 is fastened to the reel 19 and that the first cable 13 is partly wound onto it. The reel 19 exhibits a tensioning pin 20. The tensioning pin 20 is accessible from outside and permits manual winding and unwinding of the first cable 13 on the reel 19. In the configuration illustrated, the reel 19 is locked by the locking element 21 so that a rotational movement of the reel 19 is prevented by the locking element 21. The locking element 21 exhibits a first arm 22*a* and a second arm 22*b*. On the second arm 22*b* of the locking element 21, there is a projection that engages into a circumferential ratchet reel 19. On the second arm 22*b*, there is further fastened a third cable 26 that leads to one or more manual release devices so that the trigger unit 1 can also be triggered manually. On the first arm 22*a* of the locking element 21, an opening 28 formed as an elongated hole is arranged through which the first side 13*a* of the first cable 13 runs. There further rests on the first arm 22*a* of the locking element 21 a cam 27 that is fastened to the first cable 13. The cables of the first actuating device 3, the manual release devices and the cable to the holding member 15 are in each case further surrounded at least partly by a cable sheath 17*a*, 17*b*, 17*c*, 17*d*. The cable sheaths 17*a*, 17*b* that surround cables of the manual release devices, lead from the support structure 2 of the trigger unit 1 to fastening bushings. These fastening bushings can, for example, be fastened to the housing of an extinguishing device. The cable sheath 17*c* that surrounds the cable to the holding member 15, leads from the support structure 2 to a further fastening bushing. This fastening bushing can likewise be fastened to the housing of the extinguishing device. The cable sheath 17*d* that surrounds the cable of the first actuating device 3, leads from the support structure 2 to a further fastening bushing (not illustrated) that can, for example, likewise be fastened to the housing of the extinguishing device.

Figure 3:
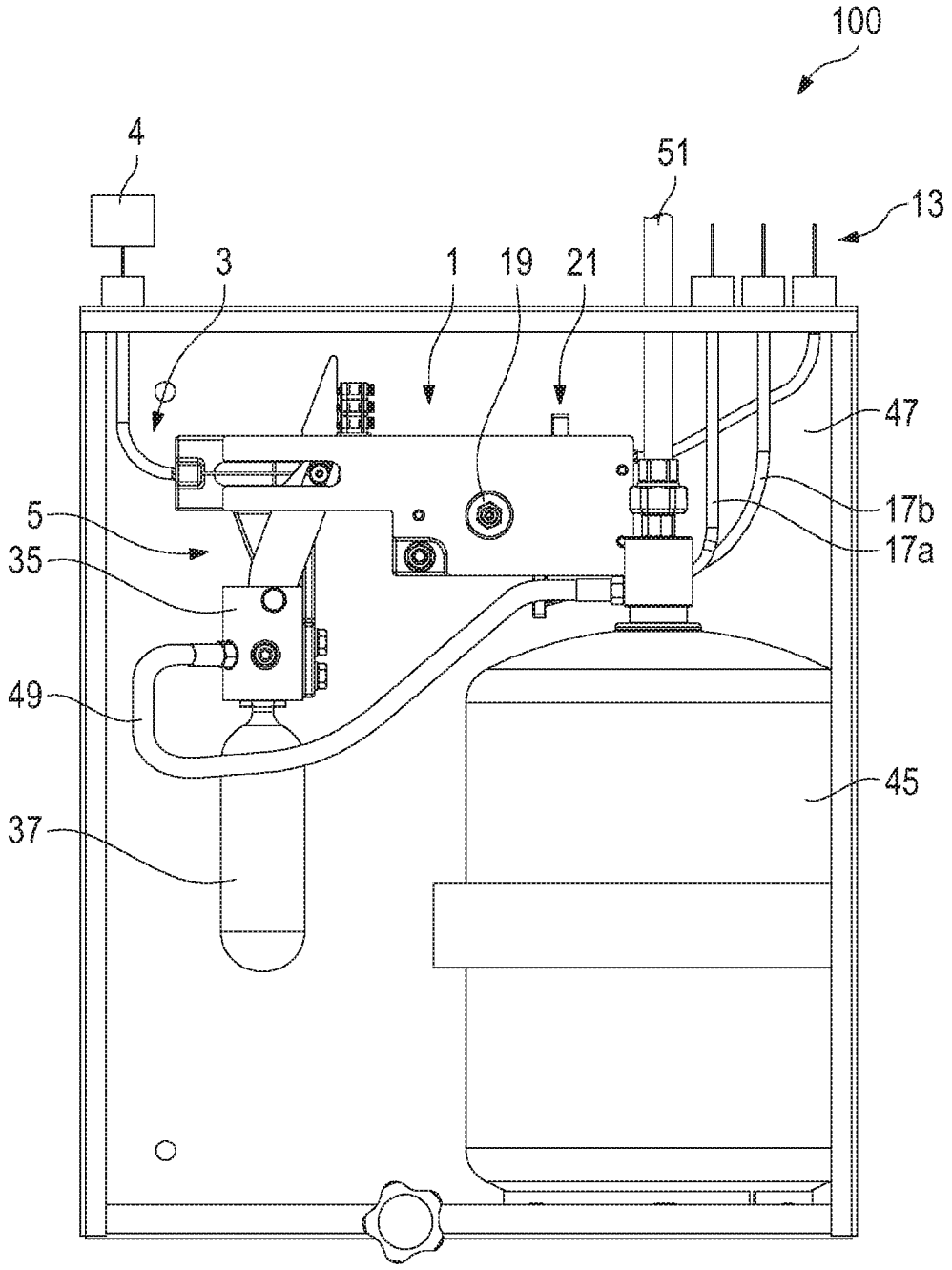
FIG. 3 shows an embodiment of an inventive extinguishing device.

FIG. 3 shows an inventive extinguishing device 100 that comprises the trigger unit 1 from FIG. 1 and FIG. 2. In the housing 47 of the extinguishing device 100, also an extinguishing-agent reservoir 45 is arranged next to the trigger unit 1. The extinguishing-agent reservoir 45 is connected via a line 49 to the receiving and distributing unit 35 to which a propellant cartridge 37 is connected. In case the trigger unit 1 is triggered, the propellant is released from the propellant cartridge 37 and is guided through the receiving and distributing unit 35 and through the line 49 into the extinguishing-agent reservoir 45. The extinguishing-agent of the extinguishing-agent reservoir is situated in a closed container in which now a pressure accumulates as a result of the pressurized propellant and the extinguishing agent is expelled from the container. This initiates an extinguishing-agent flow that is passed on through a main distributor line 51 to a discharge unit. Such discharge units, preferably designed as nozzles, are adapted to extinguish a fire in a fire zone by means of the extinguishing agent.

According to FIG. 4, the receiving and distributing unit 35 is fastened via fittings 36*a*, 36*b* to a stationary arm of the support structure 2. The actuating arm 31 is mounted so as to be pivotable about the stationary point 33. By means of the pivoting movement, the actuating arm can be moved into a rest position and into a release position. In the illustrated rest position, the closure of the propellant cartridge 37 is closed. In the case of a rotational movement of the actuating arm 31 from the rest position into the release position, the opening means 30 designed as a needle is moved along its longitudinal axis in the direction of the closure of the propellant cartridge 37. If the pressure that is exerted by the opening means 30 on the closure of the propellant cartridge 37 exceeds a threshold value, the closure is opened and the propellant that is stored under pressure in the propellant cartridge 37 is released. The propellant that is released is passed on via ports 40*a* to lines (not illustrated) that guide the propellant to an extinguishing-agent reservoir. The propellant cartridge 37 is screwed to the receiving and distributing unit 35 by means of a thread 38.

Figure 5:
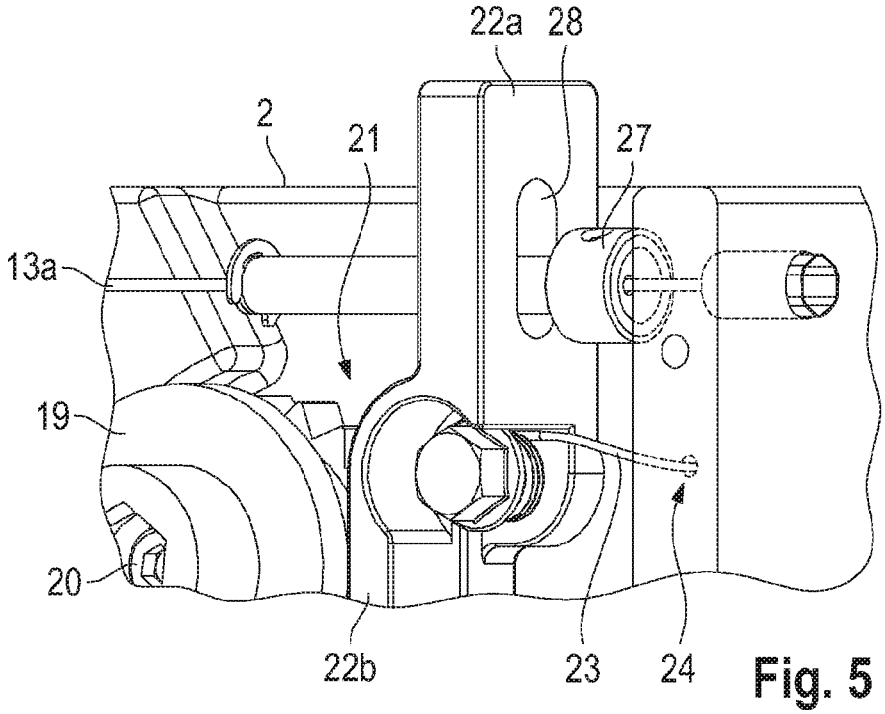
FIG. 5 shows a detailed view of parts of the trigger unit from FIG. 1.

FIG. 5 shows parts of the trigger unit 1. The locking element 21 that is mounted on the support structure 2 so as to be rotatable and is designed as a rocker, exhibits a first arm 22*a* and a second arm 22*b*. The first arm 22*a* exhibits an opening 28 that is designed as an elongated hole. The side 13*a* of the first cable 13 runs through the opening 28. There is attached to the first cable a cam 27 that is sized such that it cannot be guided through the opening 28. The cam 27 is furthermore arranged on the side 13*a* such that a distance is set between the cam 27 and the outer surface, facing the cam 27, of the locking element 21. The distance between the cam 27 and the locking element 21 is necessary so that in the case of comparatively small changes in length of the first cable 13 that can, for example, be caused by warming the first cable 13, a rotation of the locking element 21 does not take place directly. If a release of the first cable 13 occurs, for example by destroying a thermal separating member (not illustrated) connected to the first cable, the cam 27 contacts the locking element 21 and effects a rotation of the locking element 21 from the illustrated locking position into a release position. By moving the locking element 21 from the locking position into the release position, the reel 19 is released such that a rotational movement of the reel is no longer locked by the locking element 21. The locking element 21 is further coupled to a spring 23 that exerts a restoring moment on the locking element 21 in the direction of the locking position. By means of spring engagement 24, the spring 23 is connected to the support structure 2 of the trigger unit 1. So that a rotational movement of the locking element 21 takes place from the locking position into the release position, the moment that is transmitted by the cam 27 to the locking element 21 consequently has to be larger than the restoring moment that is transmitted by the restoring spring 23 on the locking element 21.

The invention claimed is:

1. A trigger unit (1) for extinguishing devices for triggering an extinguishing-agent flow in the direction of a fire zone, said zone being connected to an energy supply, having a first actuating device (3) that can be switched between a release position in which the energy supply is released, and an interruption position in which the energy supply is interrupted, a second actuating device (5) that can be switched between a release position in which the extinguishing-agent flow is released, and a rest position, a coupling unit (7) connected to the first actuating device (3) and connected to the second actuating device (5) and that can be moved between an operating position and an extinguishing position and permanently couples together the switching of the first actuating device (3) and of the second actuating device (5), and a tensioning element (9) that is connected in a force-transmitting manner to the coupling unit (7) in such a manner that a change in the tensioning state of the tensioning element always results in a movement of the coupling unit (7);

wherein in the operating position of the coupling unit (7) the tensioning element exerts a restoring force on the coupling unit (7) in the direction of the extinguishing position, the tensioning element having a spring (9);

a holding and tensioning mechanism (11) wherein in the operating position of the coupling unit (7), the holding and tensioning mechanism (11) accommodates the restoring force of the tensioning element;

wherein the holding and tensioning mechanism (11) comprises a first cable (13), the first cable (13) being connected to the coupling unit (7) via a deflection element (14);

wherein the holding and tensioning mechanism (11) comprises a stationary and rotatably mounted reel (19) to which the first cable (13) is fastened and around which it can be wound.

2. The trigger unit (1) according to claim 1, wherein in the operating position of the coupling unit, the first actuating device (3) is in the release position and the second actuating device (5) is in the rest position, and in the extinguishing position of the coupling unit the first actuating device (3) is in the interruption position and the second actuating device (5) is in the release position.

3. The trigger unit (1) according to claim 1, wherein the holding and tensioning mechanism (11) comprises a holding member (15) that is attached to a first end of the first cable (13), the holding member (15) being adapted to release the first cable (13) when limit value representing five characteristic is exceeded or when a deactivating signal is present, the holding member (15) being a thermal separation member that can be destroyed under the effect of a temperature increase in the case of a fire.

4. The trigger unit (1) according to claim 1, wherein the first actuating device (3) comprises a second cable (29) that is fastened to the coupling unit (7), and wherein the first cable (13), the deflection element (14) and the reel (19) form a block and tackle.

5. The trigger unit (1) according to claim 1, wherein the holding and tensioning mechanism (11) comprises a locking element (21) that can be movable between a locking position and a release position, the reel being prevented from rotational movement in the locking position, and being released for rotational movement in the release position.

6. The trigger unit (1) according to claim 5, having a second tensioning element that exerts a restoring force on the locking element (21) in the direction of the locking position, the second tensioning element having a torsion spring (23).

7. The trigger unit (1) according to claim 5, wherein the holding and tensioning mechanism (11) comprises at least one manual release devices by means of which the locking element (21) can be moved from the locking position into the release position.

8. The trigger unit (1) according to one of claim 5, wherein a cam (27) is attached to a section of the first cable (13) and coupled to the locking element (21) such that the locking element (21) is moved from the locking position into the release position when the first end of the first cable (13) is disconnected.

9. The trigger unit (1) according to one of claim 5, wherein the locking element (21) is designed as a rocker.

10. The trigger unit (1) according to claim 5, wherein the second actuating device (5) comprises an actuating arm (31) that is mounted rotatably about a stationary point (33).

11. The trigger unit (1) according to claim 10, wherein the actuating arm (31) is arranged on a receiving and distributing unit (35) for a propellant cartridge (37).

12. The trigger unit (1) according to claim 11, wherein the actuating arm (31) comprises a guide (39) that cooperates with the coupling unit (7) such that a movement of the coupling unit (7) results in a rotation of the actuating arm (31) about a stationary point (33).

13. The trigger unit (1) according to claim 12, wherein the guide (39) exhibits an elongated hole (41) in which a pin (43) of the coupling unit (7) can be moved.

14. An extinguishing device (100) for extinguishing fires, comprising:

a trigger unit (1) for triggering an extinguishing-agent flow in a direction of a fire zone, said zone being connected to an energy supply, a propellant cartridge (37) for providing a propellant, and an extinguishing-agent reservoir (45)

the trigger unit (1) comprising:

a first actuating device (3) that can be switched between a release position in which the energy supply is released, and an interruption position in which the energy supply is interrupted, a second actuating device (5) that can be switched between a release position in which the extinguishing-agent flow is released, and a rest position, a coupling unit (7) connected to the first actuating device (3) and connected to the second actuating device (5) and that can be moved between an operating position and an extinguishing position and permanently couples together the switching of the first actuating device (3) and of the second actuating device (5), and a tensioning element (9) that is connected in a force-transmitting manner to the coupling unit (7) in such a manner that a change in the tensioning state of the tensioning element always results in a movement of the coupling unit (7);

wherein in the operating position of the coupling unit (7) the tensioning element exerts a restoring force on the coupling unit (7) in the direction of the extinguishing position, the tensioning element having a spring (9);

a holding and tensioning mechanism (11) wherein in the operating position of the coupling unit (7), the holding and tensioning mechanism (11) accommodates the restoring force of the tensioning element;

wherein the holding and tensioning mechanism (11) comprises a first cable (13), the first cable (13) being connected to the coupling unit (7) via a deflection element (14);

wherein the holding and tensioning mechanism (11) comprises a stationary and rotatably mounted reel (19) to which the first cable (13) is fastened and around which it can be wound.

15. A trigger unit (1) for extinguishing devices for triggering an extinguishing-agent flow in the direction of a fire zone, said zone being connected to an energy supply, having a first actuating device (3) that can be switched between a release position in which the energy supply is released, and an interruption position in which the energy supply is interrupted, a second actuating device (5) that can be switched between a release position in which the extinguishing-agent flow is released, and a rest position, a coupling unit (7) connected to the first actuating device (3) and connected to the second actuating device (5) and that can be moved between an operating position and an extinguishing position and permanently couples together the switching of the first actuating device (3) and of the second actuating device (5), and a spring (9) that is connected in a force-transmitting manner to the coupling unit (7) in such a manner that a change in a tensioning state of the spring always results in a movement of the coupling unit (7);

wherein in the operating position of the coupling unit (7), the spring exerts a restoring force on the coupling unit (7) in the direction of the extinguishing position;

a holding and tensioning mechanism (11) wherein in the operating position of the coupling unit (7), the holding and tensioning mechanism (11) accommodates a restoring force of the spring;

wherein the holding and tensioning mechanism (11) comprises a first cable (13), the first cable (13) being connected to the coupling unit (7) via a deflection element (14);

wherein a second cable (29) of the first actuator device (3) and the first cable (13) of the holding and tensioning mechanism (11) are connected to a pivot arm (31) of the second actuator (5).

* * * * *